United States Patent [19]

Doerr

[11] 4,012,192

[45] Mar. 15, 1977

[54] OXIDATION OF VAT OR SULFUR DYES WITH VANADATE ACTIVATED BROMATE OR IODATE

[75] Inventor: Richard L. Doerr, Orange, Conn.

[73] Assignee: Olin Corporation, New Haven, Conn.

[22] Filed: Nov. 24, 1975

[21] Appl. No.: 634,795

Related U.S. Application Data

[63] Continuation-in-part of Ser. No. 468,703, May 10, 1974, Pat. No. 3,944,382.

[52] U.S. Cl. ..... 8/34; 8/37; 8/54.2; 8/76; 8/82

[51] Int. Cl.[2] ..... C09B 9/00

[58] Field of Search ..... 8/34, 37

[56] References Cited

UNITED STATES PATENTS

| | | | |
|---|---|---|---|
| 2,382,188 | 8/1945 | Vincent et al. | 8/34 |
| 3,716,325 | 2/1973 | Aspland | 8/37 |
| 3,775,047 | 11/1973 | Weston | 8/37 |

FOREIGN PATENTS OR APPLICATIONS

| | | |
|---|---|---|
| 657,273 | 9/1951 | United Kingdom |

*Primary Examiner*—Donald Levy
*Assistant Examiner*—William E. Schulz
*Attorney, Agent, or Firm*—F. A. Iskander; Thomas P. O'Day

[57] ABSTRACT

An improved process for oxidizing vat or sulfur dyes is provided wherein the reduced form of the dye is oxidized by contact with an aqueous oxidizing agent containing in combination (a) an alkali metal, alkaline earth metal or ammonium bromate or iodate and (b) an alkali metal, alkaline earth metal or ammonium vanadate, at least one of which is an alkaline earth metal salt.

5 Claims, No Drawings

OXIDATION OF VAT OR SULFUR DYES WITH VANADATE ACTIVATED BROMATE OR IODATE

BACKGROUND OF THE INVENTION

RELATED APPLICATION

The present application is a continuation-in-part of prior co-pending application Ser. No. 468,703, filed May 10, 1974, now U.S. Pat. No. 3,944,382.

FIELD OF THE INVENTION

The present invention relates to the art of dyeing textiles with vat or sulfur dyes. More particularly, the invention relates to an improvement in fixing such vat or sulfur dyes which are present in reduced form on a fabric or textile in order to develop and improve the color characteristics of the dye on the fabric and to improve the color fastness of the dyed fabric. More particularly, the invention comprises contacting the dye in its reduced form with an aqueous oxidant solution containing in combination an alkali metal, alkaline earth metal or ammonium bromate or iodate and an alkali metal, alkaline earth metal, or ammonium vanadate in which either the vanadate or the bromate or iodate or both are alkaline earth metal salts.

PRIOR ART

It is conventional practice to apply a vat or sulfur dye to a fabric and thereafter to contact the dye in its reduced or leuco form with a suitable oxidizing agent to fix the same on the fabric. A number of oxidizing agents have been used or suggested in the dyeing art to oxidize and thereby fix vat or sulfur dyes. Of the oxidants hereinafter discussed, only chrome and acid has been widely used on a commercial scale.

The traditional oxidizing agent for vat and sulfur dyes is a mixture of sodium dichromate and acetic acid, generally referred to as chrome and acid. The principal disadvantage of using chrome and acid is that it produces heavy metal pollution in effluent streams. Due to increasing governmental control over such effluents, users are forced to clean up such effluent streams or to discontinue the use of chrome and acid entirely. As a result, sodium dichromate is fast losing its preferred position in the dyeing industry.

While chrome and acid treatment generally imparts excellent color fastness to textiles on which it is employed, it does have certain disadvantages other than the pollution problem referred to above. Textiles treated with chrome and acid are generally not easily rewettable and this necessitates the use of wetting agents in subsequent finishing operations. Also, residual chrome is difficult to remove from textiles so a soaping treatment is required before processing is completed.

To find suitable agents to replace chrome and acid, the dyeing industry has turned to halogen containing oxidants. For example, U.S. Pat. No. 2,382,188 discloses and claims the use of an aqueous solution of sodium chlorite as an oxidant for vat or sulfur dyes. Sodium chlorite, however, has not gained commercial acceptance primarily because it has been shown that sodium chlorite does not oxidize or fix some vat and many sulfur dyes to a commercially acceptable degree.

U.S. Pat. No. 3,716,325 teaches the use of an aqueous solution of sodium bromite as an oxidant for sulfur dyes. Sodium bromite has met with much wider acceptance than sodium chlorite due to the fact that it is substantially more effective for fixing vat and sulfur dyes than is sodium chlorite. Sodium bromite, however, reacts with cellulose causing undesired consumption of oxidant. Also, sodium bromite can only be used under alkaline conditions which tends to cause bleeding of the dyes.

U.S. Pat. No. 3,775,047 discloses that an aqueous acidic solution of sodium or potassium iodate is suitable as an oxidant for sulfur dyes. However, neither iodates nor bromates are effective for oxidizing all vat and sulfur dyes and this is a serious disadvantage in a commercial dyeing operation. The only other known use of bromates or iodates was disclosed in British Pat. No. 657,273 which relates to a method for paste printing with sulfuric acid esters of leuco vat dyes by the steam development method. A paste containing the sulfuric acid ester of a leuco vat dye, an acid splitter, a bromate, a vanadate and various other ingredients was first applied to a fabric. After application, the fabric was steamed in order to liberate the acid from the ester and liberate the leuco vat dye. As the leuco vat dye liberated, it was oxidized by the steam and the oxidants present in the paste. This patent teaches paste printing rather than an oxidation with an aqueous oxidant solution and for this reason alone is a commercially unacceptable process.

In my prior co-pending application it was disclosed that the efficacy of solutions of bromates or iodates is substantially improved by utilizing an alkali metal or ammonium bromate or iodate in combination with an alkali metal or ammonium vanadate in an aqueous oxidizing solution. In accordance with the present invention it has now been found that the alkaline earth metal salts as well as the alkali metal or ammonium salts may advantageously be utilized as active ingredients of the aqueous oxidant solution. The improvement thus comprises contacting a leuco vat or sulfur dye with an aqueous solution of an oxidizing agent containing in combination (a) an alkali metal, alkaline earth metal or ammonium bromate or iodate and (b) an alkali metal, alkaline earth metal or ammonium vanadate, wherein at least one of (a) or (b) is an alkaline earth metal salt.

DESCRIPTION OF THE INVENTION

In accordance with steps generally followed when dyeing with a vat or sulfur dye, a desired shade of dye is applied to a suitable fabric. The dye may be pretreated with a reducing agent prior to application to the fabric or after application but prior to the oxidation step. This reduction step may be accomplished by any known means, for example, by passing the dyed textile through an aqueous solution of an appropriate reducing agent such as sodium hydrosulfite or sodium sulfide. The purpose of the reduction step is to convert the dye to its reduced or leuco form and thereby to completely solubilize the dye in order to maximize penetration into the textile.

Following reduction, the textile is generally subjected to one or more water washings to remove excess dye and unreacted reducing agent. The fabric is then subjected to an oxidation step followed by several further washings, drying and other desirable finishing steps.

The present invention is directed to an improvement in the oxidation step of the process described generally above. The purpose of the oxidation step is at least twofold. First, oxidation develops the color of the dye since the color of the reduced dye is frequently substantially different than the color of the oxidized dye. Second, complete oxidation is required in order to maximize wash-fastness of the dyed fabric. The effectiveness of the oxidant in the oxidation step is critical in the dyeing process since the final color of the fabric will depend for the most part on the degree of oxidation. By employing a suitable oxidant, costly color adjustments are avoided.

In the present process, as in the prior art, an aqueous solution of an oxidizing agent is employed as the oxidizing bath and the dyed fabric, with the dye in reduced form thereon, is passed through or otherwise contacted by the aqueous solution of oxidizing agent.

In accordance with the present invention the aqueous oxidant solution contains in combination (a) an alkali metal, alkaline earth metal or ammonium bromate or iodate and (b) an alkali metal, alkaline earth metal or ammonium vanadate, wherein at least one of (a) or (b) is an alkaline earth metal salt. Thus, an alkaline earth metal bromate or iodate may be employed in combination with an alkali metal, alkaline earth metal or ammonium vanadate or a mixture thereof. Similarly, an alkaline earth metal vanadate may be employed in combination with an alkali metal, alkaline earth metal or ammonium bromate or mixtures thereof.

Suitable alkali metals include lithium, sodium, potassium, rubidium and cesium with the preferred alkali metals being sodium or potassium.

Suitable alkaline earth metals include magnesium, calcium, strontium and barium with the preferred alkaline earth metals being calcium or magnesium.

The selected bromate or iodate oxidant is used in aqueous solution in concentrations of from .01 to 10% by weight. It is preferred to employ low concentrations within this range in the interest of economy and a concentration of 0.01 to 5% by weight is, therefore, most preferable.

In accordance with the present invention a suitable vanadate salt is also employed in the aqueous oxidizing solution. The vanadate salt is preferably employed in smaller amounts than the oxidant and a concentration in the range of 0.005 to 5% by weight, preferably 0.01 to 2% may be employed. The amount of vanadate may also be based on the amount of oxidant employed if desired and, as so measured, a suitable weight ratio of oxidant to vanadate is from 1:1 to 100:1, preferably 1:1 to 25:1. While larger or smaller ratios may be employed, it is generally uneconomical to employ ratios outside these limits.

The mechanism of action of the vanadate salt on oxidizing characteristics of the oxidizing solution as it relates to vat or sulfur dyes is presently not known. Whatever the mechanism, the presence of vanadate in the oxidizing solution potentiates the oxidative effect of the solution on vat or sulfur dyes as shown in the accompanying examples.

Strangely, however, this potentiating effect does not substantially increase the oxidative effect of chlorates in a pH range suitable for most dyeing processes. Thus, the chlorates remain unsuitable for use at least with the dyes which have been tested. It has also been noted that vanadate does not potentiate the effect of the prior art bromites and chlorites in oxidizing vat or sulfur dyes.

In the practice of the present invention, as in the prior art, it is desirable that the oxidizing solution be slightly acid. The desired degree of acidity is preferably provided by utilizing a suitable amount of acetic acid in the oxidizing bath as is well-known in the art. The acetic acid itself, however, has no apparent oxidizing effect as shown in the accompanying examples. Obviously, other weak acids and various mineral acids could be employed as well. It is, however, desirable to avoid excess acidity, since it can damage fabrics. For example, it is not desirable to utilize a pH of less than about 3 nor more than about 6 and a pH of 3–4 is preferred.

The aqueous solution of sodium bromate may be employed at any desired temperature presently employed by dyers. Suitably, temperatures ranging from 60° F. to 205° F. and preferably 75° to 200° F. may be employed. With fabrics which are less susceptible to coloration, for example, nylon, acrylics and cellulose acetate, it is preferred to utilize the oxidation solution at a temperature in the upper portion of the preferred range, for example, from 140° F. to 200° F.

The present process may be employed in the fixing of vat or sulfur dyes which are well-known to those skilled in the art. For purposes of illustration, however, suitable vat dyes include but are not limited to Vat Orange 15 (C.I. 69025), Vat Green 1 (C.I. 59825), Vat Red 1 (C.I. 73360), Vat Violet 13 (C.I. 68700), Vat Blue 20 (C.I. 59800), Vat Yellow 13 (C.I. 65425). Similarly, suitable sulfur dyes include but are not limited to Sulfur Yellow 2 (C.I. 53120), Sulfur Red 10 (C.I. 53228), Sulfur Blue 7 (C.I. 53440), Sulfur Green 2 (C.I. 53571), Sulfur Brown 10 (C.I. 53055) and Sulfur Black 2 (C.I. 53195). Color codes given in parentheses indicate standards for colors set forth in COLOUR INDEX, Second Edition, Supplement 1963, published by The Society of Dyers and Colourists, Yorkshire, England.

The present invention may be employed in connection with dyeing all textiles which are susceptible of coloration by vat or sulfur dyes. For example, cotton and regenerated cellulose are the principal textile materials on which vat or sulfur dyes are generally used. However, any fabric having cotton or regenerated cellulose in combination with fibers which are not easily dyed with vat or sulfur dyes may be employed if the cotton or regenerated cellulose portion of the fabric constitutes more than a minor portion, for example, more than 20% of the fibers present in the fabric. Cotton/polyester fabrics, for example, usually have about 25 to 50% cotton and may suitably be dyed with vat or sulfur dyes. Certain acrylic fibers, alone or in combination with cotton or regenerated cellulose may also be dyed with vat or sulfur dyes, for example, Chemstrand's Acrilon and Dow's Zephran. Finally, nylon or combinations thereof with other susceptible fibers may be dyed with these dyes. It is, therefore, preferred to utilize textiles of cotton or regenerated cellulose or combinations of fibers wherein cotton or regenerated cellulose is more than a minor constituent of the textile.

The present invention is applicable to dyeing the above-identified fibers or fiber combinations regardless of form. For example, yarns, woven or non-woven fabrics may all be employed in accordance with the present invention.

The present invention may be employed equally well with various methods for dyeing. It is recommended for use in package dyeing, continuous dyeing and in jig batch dyeing procedures. It may be necessary in package dyeing, however, to adjust the concentration of oxidant upwardly from the preferred minimums but no other adjustments are generally required.

When practiced in accordance with the principles set forth above, the present process provides the dyer with an oxidant for vat and sulfur dyes that has unexpectedly improved oxidizing characteristics, is inexpensive and is effective with vat or sulfur dyes which were difficult to oxidize to an acceptable degree with iodates or bromates alone.

Having thus fully described the present invention, the following examples will illustrate the practice and advantages thereof. In these examples, SODYESUL Liquid Brown 7RCF was employed as a dye on which to demonstrate the effect of vanadate in the oxidizing bath. It is one of the dyes which causes difficulty with bromites, chlorites, bromates and iodates and undergoes a definite color change during oxidation which makes it easy to determine the degree of oxidation by visual examination and/or reflectance readings.

EXAMPLE 1

A dye formulation containing 90g/l SODYESUL Liquid Brown 7RCF, Southern Dyestuff Co., Division Martin Marietta Corporation, (Sulfur Red 10, C.I. 53228) and 30g/l SODYEFIDE B sodium sulfide solution (also Southern Dyestuff Co.) was prepared and applied to a sample of finely woven 100% cotton twill fabric using a laboratory padder. The fabric was steamed for one minute then rinsed in warm water to remove excess dye and wrung out to remove excess water. The fabric was then dipped 10 times in an aqueous oxidizing solution containing 7.5g/l sodium dichromate, and 7.5g/l acetic acid, rinsed and ironed dry. Oxidation appeared essentially complete after 2 dips by visual observation. Reflectance of the resulting dyed fabric was measured (after 10 dips) and adjusted to a reading of 50 on a scale of 1–100 as a standard for the following examples.

EXAMPLES 2–19

Additional fabric samples which had been dyed as in Example 1 were dipped 10 times in an oxidation bath comprising the active ingredients shown in Table I. Visual observation was made after each dip to determine the degree of oxidation by change in color which had occured. After 10 dips, the visual observation was confirmed by measuring the reflectance of the dyed fabric on the reflectometer which has been standardized for chrome/acetic acid in Example 1. The results are reported in Table I.

From the foregoing tabulation, it is apparent that acetic acid alone or either the vanadate or bromate in combination with acetic acid is not a satisfactory oxidant regardless of the salt form utilized. However, when the vanadate salt and the bromate salt are combined in the aqueous oxidizing solution, oxidation occurs rapidly and completely regardless of the salt employed.

EXAMPLE 20

Example 2 was repeated utilizing an aqueous oxidizing solution comprising 0.45 g/l sodium iodate and 7.5 g/l acetic acid. Afer 10 dips, oxidation appeared only partially complete. A reflectance reading of 80 confirmed the visual observation.

EXAMPLE 21

Example 20 was repeated utilizing an aqueous oxidizing solution comprising 0.45 g/l sodium iodate, 0.1 g/l sodium vanadate and 7.5 g/l acetic acid. After 5–6 dips, oxidation appeared substantially complete. A reflectance reading of 60 after 10 dips confirmed the visual observation.

EXAMPLE 22

Example 2 was repeated utilizing an aqueous oxidizing solution comprising 0.45 g/l sodium chlorate and 7.5 g/l acetic acid. After 10 dips, oxidation was incomplete. A reflectance reading of 87 was obtained.

EXAMPLE 23

Example 22 was repeated utilizing an aqueous ozidizing solution comprising 0.45 g/l sodium chlorate, 0.1 g/l sodium vanadate and 7.5 g/l acetic acid. After 7 dips, little oxidation appeared to have taken place. After 10 dips, a reflectance reading of 87 was obtained confirming this visual observation.

What is claimed is:

1. In a process for oxidizing vat or sulfur dyes present in reduced form on cotton or regenerated cellulose textile fibers by contacting said dye with an aqueous oxidant solution, the improvement wherein said aqueous oxidant solution consists essentially of a. 0.01–10% of an oxidizing agent comprising an alkali metal, alkaline earth metal or ammonium bromate or iodate and

TABLE I

| EXAMPLE | BATH COMPOSITION | | | DIPS[1] | REFLECTANCE[2] |
|---|---|---|---|---|---|
| | $BrO_3$ Salt (0.45 g/l) | $VO_3$ Salt (.04 g/l) | Acetic Acid (7.5 g/l) | | |
| 2 | Na | — | " | 10 | 100 |
| 3 | Ca | — | " | 10 | 100 |
| 4 | Mg | — | " | 10 | 100 |
| 5 | — | Na | " | 10 | 100 |
| 6 | — | $NH_4$ | " | 10 | 100 |
| 7 | — | Ca | " | 10 | 100 |
| 8 | — | Mg | " | 10 | 100 |
| 9 | — | — | " | 10 | 100 |
| 10 | Na | Ca | " | 3–4 | 55 |
| 11 | Na | Mg | " | 3–4 | 56 |
| 12 | Ca | Na | " | 3–4 | 54 |
| 13 | Ca | $NH_4$ | " | 3–4 | 55 |
| 14 | Ca | Ca | " | 3–4 | 53 |
| 15 | Ca | Mg | " | 3–4 | 53 |
| 16 | Mg | Na | " | 3–4 | 56 |
| 17 | Mg | $NH_4$ | " | 3–4 | 55 |
| 18 | Mg | Ca | " | 3–4 | 57 |
| 19 | Mg | Mg | " | 3–4 | 53 |

[1]Number required to complete oxidation by visual observation. 10 indicates incomplete oxidation.
[2]After 10 dips.

b. 0.005 to 5% by weight of an alkali metal, alkaline earth metal or ammonium vanadate and wherein at least one of (a) and (b) is an alkaline earth metal, c. the remainder water.

2. The process of claim 1 wherein the weight ratio of said oxidizing agent to said vanadate is 1:1 to 100:1.

3. The process of claim 2 wherein said dye is a sulfur dye.

4. The process of claim 3 wherein said oxidizing agent is the alkali metal or ammonium salt and said vanadate is the alkaline earth metal salt.

5. The process of claim 3 wherein said oxidizing agent is sodium, potassium or ammonium bromate or iodate and said vanadate is magnesium or calcium vanadate.

* * * * *